US006194834B1

(12) United States Patent
Seiler et al.

(10) Patent No.: US 6,194,834 B1
(45) Date of Patent: Feb. 27, 2001

(54) GAS DISCHARGE LAMP, IN PARTICULAR FOR A MOTOR-VEHICLE HEADLIGHT

(75) Inventors: Hartmut Seiler, Baden-Baden; Robert Kern, Sasbachwalden, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/142,788

(22) PCT Filed: Mar. 6, 1997

(86) PCT No.: PCT/DE97/00425

§ 371 Date: Jan. 8, 1999

§ 102(e) Date: Jan. 8, 1999

(87) PCT Pub. No.: WO97/35336

PCT Pub. Date: Sep. 25, 1997

(30) Foreign Application Priority Data

Mar. 16, 1996 (DE) ..... 196 10 385

(51) Int. Cl.[7] ..... H01J 7/44; H01J 5/48

(52) U.S. Cl. ..... 315/82; 315/60; 313/318.09; 362/265

(58) Field of Search ..... 315/77, 80, 82, 315/246, 276, 85, 60, 59, 58, 209 R; 313/318.08, 318.09; 362/221, 265, 267

(56) References Cited

U.S. PATENT DOCUMENTS

| | | | | |
|---|---|---|---|---|
| 4,097,777 | * | 6/1978 | Bacharowshi | 315/60 |
| 4,447,759 | * | 5/1984 | Moerkens et al. | 315/60 |
| 4,714,986 | | 12/1987 | Wurster | 362/267 |
| 4,769,578 | * | 9/1988 | Jacobs et al. | 315/60 |
| 5,059,865 | * | 10/1991 | Bergman et al. | 315/82 |
| 5,436,533 | * | 7/1995 | Fromm et al. | 315/246 |
| 5,489,825 | * | 2/1996 | Rimmer | 315/246 |

FOREIGN PATENT DOCUMENTS

| | | |
|---|---|---|
| 35 19 611 | 12/1986 | (DE) . |
| 150 799 | 8/1985 | (EP) . |
| 203 545 | 12/1986 | (EP) . |
| 6-314555 | 11/1994 | (JP) . |

OTHER PUBLICATIONS

"Lamps and Lighting," A manual lamps and lights prepared by members of staff of Thorn Lighting Ltd., Henderson et al., Crane, Russak & Company, Inc., New York, 1972, pp. 327–33.

* cited by examiner

*Primary Examiner*—David Vu
*Assistant Examiner*—Wilson Lee
(74) *Attorney, Agent, or Firm*—Kenyon & Kenyon

(57) ABSTRACT

Proposed is a gaseous-discharge lamp, in particular for motor-vehicle headlamps, comprising a burner vessel of glass or the like having at least two electrodes, the burner vessel being provided with a lamp base that includes the electrical terminals and that is insertable into a lamp base socket. Arranged in the lamp base is an electronic ballast unit that supplies the lamp with the necessary ignition and maintaining voltage. By accomodating the balast unit in the lamp base, one can achieve a small-volume gaseous-discharge lamp having short high-voltage leads i an integrated type of construction, making it possible to keep the ignition voltage to a minimum.

12 Claims, 1 Drawing Sheet

GAS DISCHARGE LAMP, IN PARTICULAR FOR A MOTOR-VEHICLE HEADLIGHT

FIELD OF THE INVENTION

The present invention relates to a gaseous-discharge lamp, in particular for motor-vehicle headlamps.

BACKGROUND INFORMATION

German Patent Application No. 35 19 611 describes gaseous-discharge lamps or high-pressure discharge lamps. The ballast unit required to supply the lamps with the necessary ignition voltage and maintaining voltage is arranged in a shaped housing, which is configured on the rear part of the reflector of the motor vehicle's headlamp unit. This housing increases the overall depth of the motor vehicle's headlamp unit, it being necessary for the high-voltage conducting lines to be run from the shaped housing to the lamp's burner vessel. This entails insulation problems and line losses.

European Patent No. 150 799 describes a low-pressure gaseous-discharge lamp, in which the ballast unit is arranged at the lamp base. However, such a low-pressure gaseous-discharge lamp is not suited for motor-vehicle headlamps, and the problems associated with electrode bushings arranged at opposite end regions, in conjunction with a ballast unit configured in the lamp base, are neither addressed nor solved by this publication.

SUMMARY OF THE INVENTION

By electrically feeding back the electrode bushing arranged in the end region of the burner vessel that is distant from the lamp base via an external line to the lamp base or to the ballast unit configured therein, an altogether simple, cost-effective, and compact means is achieved for fulfilling the objective, which is suited, above all, for applications in motor-vehicle headlamps.

By integrating the ballast unit in the lamp base (i.e., cap), a very small overall volume can be achieved with virturally no increase in the size of the motor-vehicle headlamp unit as such. When the means for generating ignition voltage are accommodated in the lamp base, they are arranged virtually directly next to the an electrode of burner vessel and form a permanent unit, the result being minimal line length for the high-voltage conducting lines, in particular of the external line at the burner vessel. As a result, less line capacitance and, thus, less energy is required to arrive at the ignition voltage, and the size of the firing-pulse transformer is reduced, facilitating in turn direct installation on the burner vessel. The short (i.e., minimal length of the high-voltage carrying lines results in diminished insulation problems, and less ignition voltage is needed in the ballast unit. Should malfunctions or defects arise, merely replacing the gaseous-discharge lamp replaces the ballast unit and the high-voltage lines at the same time, making it possible to eliminate most sources of error quickly and simply.

According to one advantageous exemplary embodiment of the present invention, an inductive ignition component, is particular a firing-pulse transformer, contained in the ballast unit, has an encapsulated (i.e., toroidal) core, preferably an annular core, which makes it possible to achieve a high inductance using a small number of turns. This leads to a slow ignition pulse, and the ignition voltage can be maintained at a low level. Furthermore, the small number of turns renders possible a compact and small-volume type of construction.

The encapsulated core preferably wraps around one of the end regions of the burner vessel provided with an electrode bushing, which likewise plays a role in size reduction.

By at least partially extrusion-coating or sealing in the components required for the ballast unit, together with an end region of the burner vessel, using plastic (i.e., molding) material, a lamp base can be produced simply and cost-effectively, which besides fulfilling its task as a lamp base, will also hold the components together and bond them to the burner vessel. At the same time, this lamp base fulfills the function of an insulator, it being beneficial for the electrical connnecting terminals of the lamp base to be extrusion-coated or sealed in along with the components, so that virtually the entire lamp base is produced in one sequence of operation.

A simpler and cost-effective means for achieving the objective makes it possible for the region of this external line running in the lamp base to be advantageously extrusion-coated or sealed in at the same time.

Besides reducing ignition energy losses by using short high-voltage lines, one can also advantageously reduce the ignition voltage by installing an auxiliary electrode. It is beneficial in this case for the external line to be connected to an auxiliary electrode or to form such an electrode, this auxiliary electrode being preferably arranged near the first main electrode next to the base.

One achieves ease of manufacturing and a cost-effective way to fulfill the objective by configuring the auxiliary electrode as a wire or conductive strip adjoining the burner vessel on the outside.

In another advantageous exemplary embodiment, the polarity of the first main electrode next to the base is negative in comparison to the polarity of the other, second main electrode linked to the auxiliary electrode. This ensures that, following the initial spark, which jumps from the first main electrode near the base to the auxiliary electrode and, in fact, through the glass wall of the burner vessel, the subsequent sparks can follow in the direction of the second main electrode, without any polarity reversal of the first main electrode.

DESCRIPTION OF THE EXEMPLARY EMBODIMENT

Figure 1:
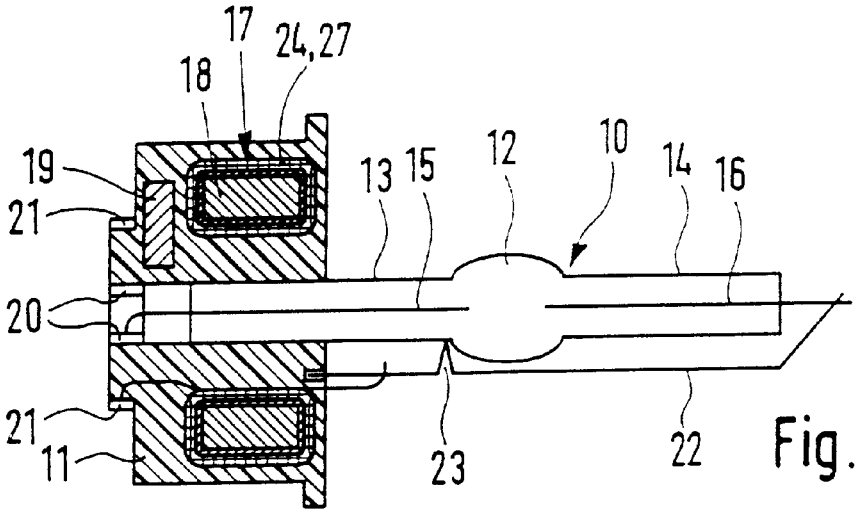
FIG. 1 shows a sectional view of an exemplary embodiment of a gaseous-discharge lamp according to the present invention.

The gaseous-discharge lamp shown in FIG. 1 is essentially made up of a burner vessel 10 that is embedded in a lamp base 11. Burner vessel 10 made of glass or of another transparent, temperature-resistant material has a central combustion chamber 12 with a flattened spherical or ellipsoidal shape, and having two tubular extensions 13, 14 on opposite sides. The end regions of these tubular extensions 13, 14 are designed as gas-tight bushings for two main electrodes 15, 16, which extend from both sides slightly into combustion chamber 12. The arc is formed between these main electrodes 15, 16 during operation.

Lamp base 11 is designed as a sealed-in part or as an injection-molded part and is made of an insulating plastic material. It includes a firing-pulse transformer 17, which is made up of an annular core 18 and a winding arrangement 24, 27 for annular core 18. Annular core 18 wraps concentrically around the first tubular extension 13, which extends into lamp base 11. Also contained in lamp base 11 are electronic components 19, which are merely shown schematically and which, together with firing-pulse transformer 17, form a ballast unit, which supplies the lamp with the necessary ignition and maintaining voltage.

In addition, lamp base 11 has two annular, electrical terminals 20, 21, the inner one being linked to first main electrode 15, and the outer to firing-pulse transformer 17. A second terminal of firing-pulse transformer 17 is linked to an external line 22, which extends from lamp base 11, in a direction essentially parallel to burner vessel 10, and is electroconductively connected by its unattached end to second main electrode 16. This external line 22 is designed as a wire or bar. In the connection region between the first tubular extension 13 and combustion chamber 12, external line 22 is run to this first extension 13 and forms there an external auxiliary electrode 23, which is thus electrically connected to second main electrode 16. This auxiliary electrode 23 can also be designed as a conductive strip, e.g., as an enameled conductive strip of fluid silver or the like. The polarity of first main electrode 15 near the base is negative in comparison with the polarity of second main electrode 16 and of auxiliary electrode 23, to ensure that, following the initial spark, which jumps through the glass, from main electrode 15 to auxiliary electrode 23, the subsequent spark can follow all the way to second main electrode 16 without any polarity reversal of main electrode 15.

Firing-pulse transformer 17, burner vessel 10, electronic components 19, electrical terminals 20, 21, as well as external line 22 are extrusion-coated or sealed in, together with the plastic material, forming lamp base 11. Lamp base 11 facilitates insertion of the lamp into a base socket (i.e., bulb socket), for example of a motor-vehicle headlamp.

Figure 2:
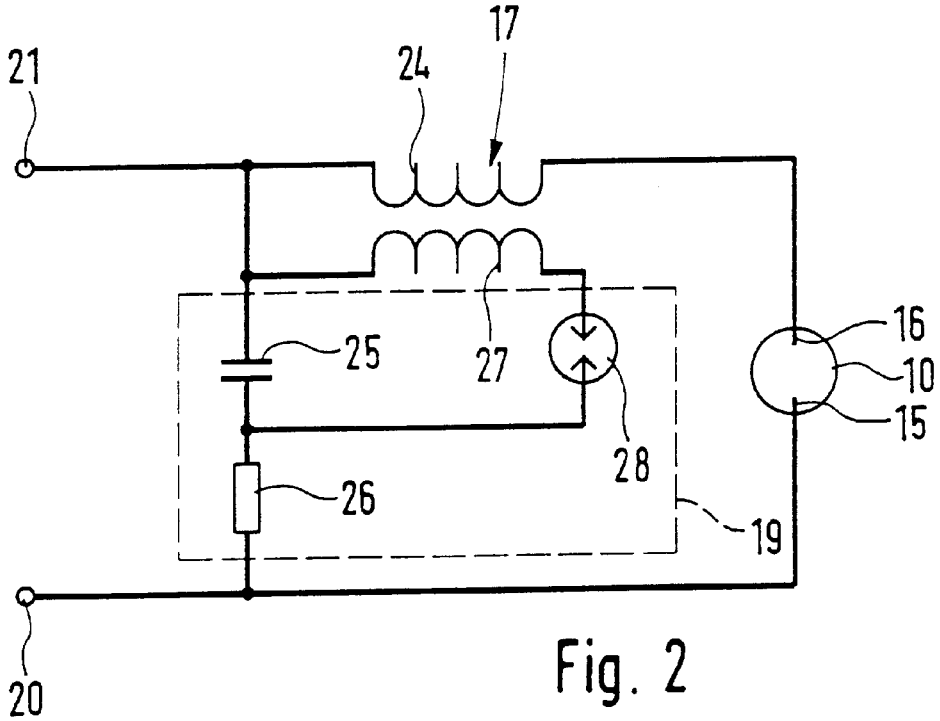
FIG. 2 shows an exemplary embodiment of a ballast unit according to the present invention.

FIG. 2 depicts an exemplary embodiment of a circuit for a ballast unit. The two electrical terminals 20, 21 are interconnected via the series connection of a first winding 24 of firing-pulse transformer 17 to the two main electrodes 15, 16 of burner vessel 10. In addition, the two electrical terminals 20, 21 are connected via the series connection of a capacitor 25 to a resistor 26. In parallel to capacitor 25, the series connection of a second winding 27 of firing-pulse transformer 17 is connected to spark gap 28. The circuit shown in FIG. 2 represents merely one of many known possibilities for such a ballast unit. Other circuit arrangements for ballast units of gaseous-discharge lamps are described and depicted, for example, in "Lamps and Lighting", S. T. Henderson et al., 2nd Ed., pp. 328 ff. The multiplicity of circuit arrangements described therein reveal, inter alia, that in some circuit arrangements, firing-pulse transformer 17 can be designed as a simple choke or coil.

In a variation of the illustrated exemplary embodiment, lamp base 11 can also be designed as a prefabricated housing for accommodating the components, such as firing-pulse transformer 17, burner vessel 10, electrical components 19, electrical terminals 20, 21, and external line 22. It is also possible that only some of these components are extrusion-coated or sealed in, while the others are accommodated in a prefabricated housing.

In a simpler variant, auxiliary electrode 23 may be omitted, have a different shape, or also be configured separately with an electrode having an applied ignition voltage.

What is claimed is:

1. A gaseous-discharge lamp, comprising:

a lamp base including electrical terminals and being insertable into a base socket;

a burner vessel including at least two electrodes, a combustion chamber, a first tubular extension and a second tubular extension, the burner vessel being composed of a glass material, the first tubular extension including a first main electrode and a first end region, the first tubular extension extending from the combustion chamber in a first direction, the second tubular extension including a second main electrode and a second end region, the second tubular extension extending from the combustion chamber in a second direction which is opposite to the first direction, the first end region including a first electrode bushing, the second end region including a second electrode bushing, the second end region being situated opposite to the first end region, wherein the second electrode bushing is extended, via an external line, to the lamp base and coupled to a corresponding electrical terminal of the electrical terminals, wherein the second end region is embedded in the lamp base; and an electronic ballast unit supplying the gaseous-discharge lamp with a predetermined ignition and maintaining voltage, wherein the electronic ballast unit is arranged in the lamp base.

2. The gaseous-discharge lamp according to claim 1, wherein a headlamp of motor vehicle includes the gaseous-discharge lamp.

3. The gaseous-discharge lamp according to claim 1, wherein an inductive ignition component of the ballast unit includes an encapsulated core.

4. The gaseous-discharge lamp according to claim 3, wherein the inductive ignition component includes a firing-pulse transformer.

5. The gaseous-discharge lamp according to claim 3, wherein the encapsulated core is an annular core.

6. The gaseous-discharge lamp according to claim 3, wherein the encapsulated core wraps around the first end region.

7. The gaseous-discharge lamp according to claim 1, wherein the ballast unit includes components, the components at least partially being one of extrusion-coated and sealed in together with the first end region with a plastic material, and wherein the lamp base is composed of the plastic material.

8. The gaseous-discharge lamp according to claim 7, wherein the electrical terminals are one of simultaneously extrusion-coated and simultaneously sealed.

9. The gaseous-discharge lamp according to claim 1, wherein a further external line one of is connected to an auxiliary electrode and forms the auxiliary electrode.

10. The gaseous-discharge lamp according to claim 9, wherein the auxiliary electrode is arranged near the first main electrode.

11. The gaseous discharge lamp according to claim 9, wherein the auxiliary electrode is one of a wire and a conductive strip, the auxiliary electrode positioned near an outside portion of the burner vessel.

12. The gaseous-discharge lamp according to claim 9, wherein the first main electrode has a first polarity and the second main electrode has a second polarity, the first polarity being negative in comparison to the second polarity, and wherein the second main electrode is coupled to the auxiliary electrode.

* * * * *